US006836904B2

(12) United States Patent
Harper

(10) Patent No.: US 6,836,904 B2
(45) Date of Patent: Jan. 4, 2005

(54) WELDING SHIRT

(76) Inventor: Bobby Joe Harper, 1115 Delaney Rd., LaMarque, TX (US) 77568

( * ) Notice: Subject to any disclaimer, the term of this patent is extended or adjusted under 35 U.S.C. 154(b) by 302 days.

(21) Appl. No.: 10/260,626

(22) Filed: Sep. 30, 2002

(65) Prior Publication Data

US 2004/0060093 A1 Apr. 1, 2004

(51) Int. Cl.[7] ..... A41D 1/00
(52) U.S. Cl. ..... 2/115; 2/59
(58) Field of Search ..... 2/16, 20, 59, 115, 2/81, 158, 159, 163, 164, 167, 458, 94, 108, 69, 125, 126

(56) References Cited

U.S. PATENT DOCUMENTS 1,284,536 A * 11/1918 Yaeger ..... 2/59
2,388,234 A * 11/1945 Abel ..... 2/51
2,394,136 A * 2/1946 Bakke ..... 2/16
3,374,487 A * 3/1968 Slimovitz ..... 2/16
3,889,297 A * 6/1975 Jarboe et al. ..... 2/16
4,445,232 A * 5/1984 Nelson ..... 2/16
4,884,297 A * 12/1989 Triche ..... 2/16
5,210,878 A * 5/1993 Triche ..... 2/16
6,240,565 B1 * 6/2001 Spear ..... 2/158

* cited by examiner

*Primary Examiner*—Tejash Patel
(74) *Attorney, Agent, or Firm*—James E. Hudson, III; Keeling Hudson LLC

(57) ABSTRACT

This invention is an article of protective apparel having pliable, insulative panels integral to a sleeve or sleeves, with the protective panels so positioned to cover the postern of the forearm, elbow and segment of the upper arm vulnerable to conductive heat during welding operations or the like. As such the apparel provides protection from being in close proximity to heated surfaces, while providing improved movement and maintaining an appearance of a typical work shirt.

16 Claims, 2 Drawing Sheets

WELDING SHIRT

CROSS-REFERENCE TO RELATED APPLICATIONS

Not applicable

STATEMENT REGARDING FEDERALLY SPONSORED RESEARCH OR DEVELOPMENT

Not applicable.

BACKGROUND OF THE INVENTION

1. Field of the Invention

This invention relates generally to personal heat protection devices, and more specifically to apparel article to protect a person's forearms, wrists, and elbows from work-surface heat transfer from welding.

2. Description of the Prior Art

Hazards due to burns from heat absorbed by and radiated from work materials during the welding process are well known in the welding trade. When performing welding, a standard practice is for the welder to rest one or both arms on the work material for stability. As a result of such contacts welders are likely to receive burns from heat radiated from the work-surface and through the welder's clothing adjacent to, or in contact with the work-surface. While various protective articles have been developed to protect the welder's arms, such as gloves and pads, very few are known which serve to protect the forearm, wrist and the elbow of a welder from heat and burns.

The need arises for a protective article providing protection for the forearm, wrist, and elbow of a welder, in combination with standard clothing. The article should provide for insulation for the protection of the forearm, wrist, and elbow, which may be near or in contact with a relatively hot metal structure, without substantially detracting from the comfort, mobility and typical appearance provided by more conventional articles of clothing.

Numerous methods to prevent heat transfer into the arms of welders. U.S. Pat. No. 2,388,234, issued to Abel on Nov. 6, 1945, discloses a welder's protective cape having an adjustable collar, which may be turned up for protection and straps for tightening the sleeves at the wrist for additional protection. U.S. Pat. No. 2,394,136, issued to Bakke on Feb. 5, 1946, discloses a welder's glove having a shield above the fingers. U.S. Pat. No. 3,374,487, issued to Slimovitz on Mar. 26, 1968, discloses a welder's glove with a relatively large protective cuff retained in snug engagement with the sleeve of the welder by a loop and hook fastener. U.S. Pat. No. 3,889,297, issued to Jarboe and Groseclose on Jun. 17, 1975, discloses a firefighter's glove with a relatively large protective cuff retained in snug engagement with the sleeve of the welder by a loop and hook fastener. U.S. Pat. No. 4,445,232, issued to Nelson on May 1, 1984, discloses a welder's glove having an elongated deerskin cuff. U.S. Pat. No. 4,884,297, issued to Triche on Dec. 5, 1989, discloses an arm protection, separate from any sleeve, which completely surrounds the arm and is retained in a closed position by ties. U.S. Pat. No. 5,210,878, also issued to Triche on Mar. 13, 1992, discloses a shirt having a collar, a cape, means for attaching a welding apron, removable resilient and insulating pads constructed of closed cell foam plastic inserted into pockets in the lower side of the sleeves at the forearm, and elastic bands at the forearm for retaining in position. None of the above noted patents, either singly or in combination, are seen to disclose the specific arrangement of concepts disclosed by the present invention.

BRIEF SUMMARY OF THE INVENTION

Accordingly, the objectives of this invention are to provide, inter alia, a new and improved welding shirt that:

provides improved heat protection of the forearm, wrist and elbow of a welder when in contact with a heat-radiating surface;

provides relative comfort to the wearer; and remains oriented to provide protection to vulnerable areas of the body while the wearer moves to perform work.

With the view of these and other objects, which will more readily appear as the nature of the invention is better understood, the invention consists in the novel combination and arrangement of parts hereinafter more fully described, illustrated and claimed with reference being made to the attached drawings.

These objectives are accomplished by a long-sleeve shirt apparel item, featuring additional permanent insulation at the points most likely to be in contact with heated materials—the ulnar side of the forearm, and the postern of the upper arm and elbow.

An exemplary embodiment of this invention is illustrated in the accompanying drawings. The drawings are illustrative only, and changes may be made in the specific construction illustrated and described within the scope of the appended claims. Other objects of the invention will become apparent from time to time throughout the specification hereinafter disclosed.

BRIEF DESCRIPTION OF THE DRAWINGS

Components of the device depicted in the drawings and their corresponding reference numbers are as follows.

Figure 1:
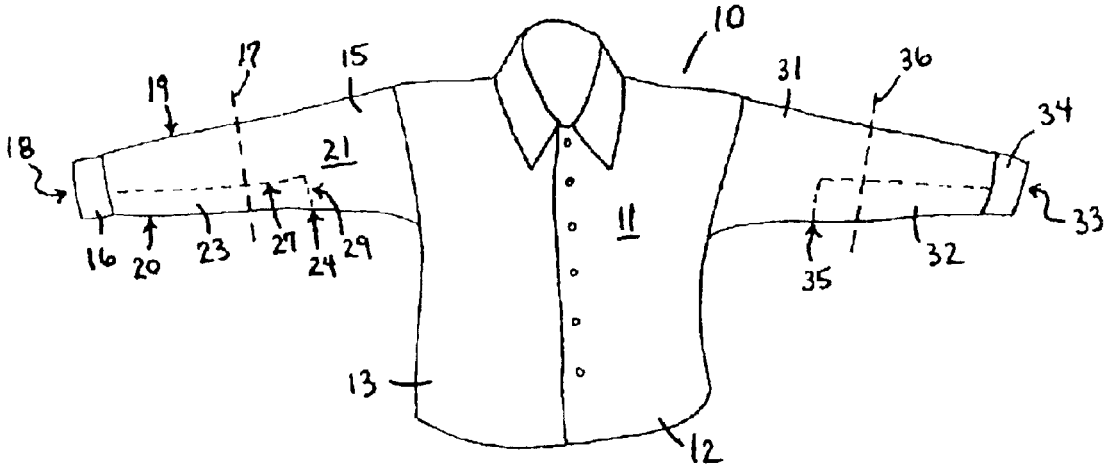
FIG. 1 is a front view of a welder's shirt.

10 Welder's shirt
11 Front panel
12 Front panel left portion
13 Front panel right portion
14 Rear panel
15 Right principal sleeve
16 Right cuff
17 Right sleeve midpoint
18 Right sleeve interior
19 Right sleeve upper edge
20 Right sleeve lower edge
21 Right sleeve front
22 Right sleeve back
23 Right partial secondary sleeve
24 Point well above right sleeve midpoint
25 Wearer's elbow
26 Wearer
27 Right partial secondary sleeve first edge
28 Right partial secondary sleeve second edge
29 Right partial secondary sleeve top edge
30 Right partial secondary sleeve bottom edge
31 Left principal sleeve
32 Left partial secondary sleeve
33 Left sleeve interior
34 Left cuff
35 Point well above left sleeve midpoint

36 Left sleeve midpoint
37 Wearer's forearm
38 Work-surface
39 Wearer's wrist

DETAILED DESCRIPTION OF THE INVENTION

Figure 2:
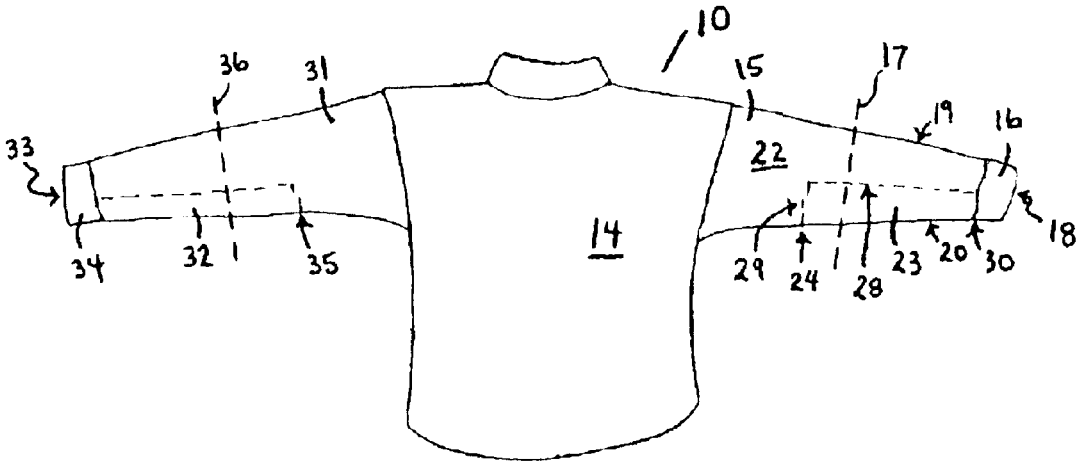
FIG. 2 is a rear view of a welder's shirt.
Figure 3:
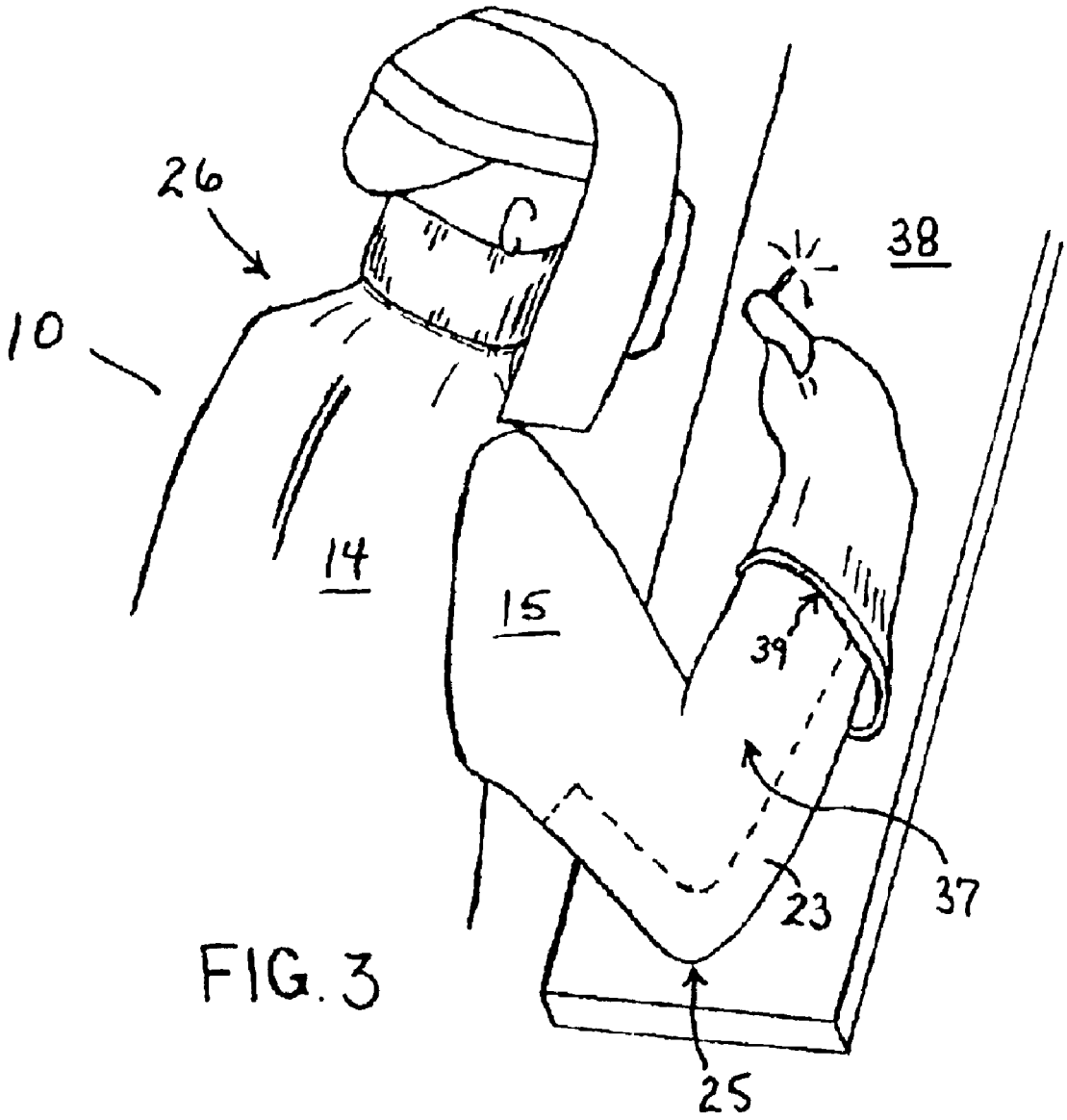
FIG. 3 is perspective view of the sleeve of a welder's shirt in an articulated position illustrating the area of additional insulation.

The present invention is a welder's shirt 10, generally depicted in FIGS. 1–3. The exemplary embodiment of the welder's shirt has a rear panel 14, a front panel 11, a right principal sleeve 15, a left principal sleeve 31, a right interior partial secondary sleeve 23, and a left partial secondary sleeve 32. While welder's shirt 10 is described as being constructed with two insulated sleeves and used in a welding situation, FIG. 3, it is understood that welding shirt 10 may be of different configurations and used in any location where a heat-radiating surface is encountered.

The present invention will be seen to relate to a welder's shirt 10 having a partial secondary sleeve 23 and 32, right and left respectively, permanently attached to the interior section of each sleeve, 18 and 33, right and left respectively, for use by a welder, or the like, for the protection of the forearm 37, wrist 39, and elbow 25, from radiated or conducted heat while engaged in such activities, while maintaining the mobility and appearance of a typical work shirt.

Partial secondary sleeves 23 and 32, right and left respectively, of the present invention respond to this need by providing additional thickness permanently attached from cuffs 16 and 34, right and left respectively, of each sleeve 15 and 31, right and left respectively, to a point, 24 and 35, right and left respectively, well above the midpoint 17 and 36, right and left respectively, of each sleeve 15 and 31, right and left respectively, so as to terminate above the elbow 25 of wearer 26. Partial secondary sleeves 23 and 32, right and left respectively, may comprise sheets of insulating material, which may be of the same material as the shirt or other insulating material.

Partial secondary sleeves 23 and 32, right and left respectively, are preferably formed of a resilient and flexible material of sufficient thickness to provide sufficient insulating properties, to provide comfort for the wearer of sleeve when resting his forearm upon a relatively hard surface and to permit ease of movement without restriction.

Welder's shirt 10 is constructed from front panel 11, which has a left portion 12 and right portion 13. Front panel 11 may be a two-piece front, typical of a button or snapped shirt or a one-piece front, typical of a pullover shirt. A back panel 14 is permanently attached to front panel 11 to form a typical shirt-like structure. A right principal sleeve 15 is permanently attached to the right portion 13 of front panel 11 and extends to right cuff 16. Right principal sleeve 15 has a lateral midpoint 17, which while worn is positioned generally at the wearer's elbow 25. Right principal sleeve 15 has suitable length so that right cuff 16 is generally proximate wearer's wrist 39 while wearer's elbow 25 is straight, bent or moving there between. Right principal sleeve 15 has interior 18, upper edge 19, lower edge 20, front 21, and back 22. Right partial secondary sleeve 23 is permanently attached within right principal sleeve 15 so as to provide additional thickness permanently attached from right cuff 16 of right principal sleeve 15 to a point 24 well above the midpoint 17 of right principal sleeve 15, so as to terminate above the elbow 25 of wearer 26. Right partial secondary sleeve 23, when worn, extends over a sufficient portion of the distance from upper edge 19 of right principal sleeve 15 to lower edge 20 of right principal sleeve 15 to ensure that as wearer 26 moves the additional thickness of right partial secondary sleeve 23 remains oriented over the areas that require protection.

Right partial secondary sleeve 23 has first edge 27, second edge 28, top edge 29, and bottom edge 30. Bottom edge 30 of right partial secondary sleeve 23 is attached to interior 18 of right principal sleeve 15 at right cuff 16. Top edge 29 of right partial secondary sleeve 23 is attached to interior 18 of right principal sleeve 15 at a point between midpoint 17 and front panel 11. This permanently affixes the insulating material at a point above elbow 25 when in use. First edge 27 of right partial secondary sleeve 23 is attached to interior 18 of right principal sleeve 15 between upper edge 19 of right principal sleeve 15 and lower edge 20 of right principal sleeve 15 on front 21 of right principal sleeve 15. Second edge 28 of right partial secondary sleeve 23 is attached to interior 18 of right principal sleeve 15 between upper edge 19 of right principal sleeve 15 and lower edge 20 of right principal sleeve 15 on back 22 of right principal sleeve 15. This construction creates the insulating pad extending from the wearer's wrist 39 to a point above wearer's elbow 25, and upwards on sleeve 15 to a point where sleeve 15 would not contact the work-surface in standard use. Other anticipated embodiments include a welder's shirt possessing a second sleeve, or a left sleeve only-shirt, constructed in a similar manner.

The use of a supple insulating material for partial secondary sleeves 23 and 32, right and left respectively, creates a constant thickness in the sleeve, which avoid the resulting destabilizing "ridge" between the welder's forearm 37 and the work-surface 38, as the closed cell foam plastic insulating insert disclosed in U.S. Pat. No. 5,210,878 issued to Triche. A further improvement of the instant invention over the welder's cape disclosed in '878 patent, is the wearer's elbow 25 in the instant invention is insulated from heat radiated from work-surface 38. A further improvement of the instant invention over the welder's cape disclosed in the '878 patent is the more equal distribution of the weight of partial secondary sleeves 23 and 32, right and left respectively, in 18 and 33, right and left respectively, as opposed to the unequal distribution of weight as a result of the pad disclosed in the '878 patent. A further improvement of the prior art is the permanence of secondary sleeves 23 and 32, right and left respectively, which removes the need to remove and separately store the insulating pad as disclosed in the '878 during washing. A further improvement over the '878 patent is the ability to construct shirt 10 and partial secondary sleeves 23 and 32, right and left respectively, from the same material, thus eliminating additional materials and costs, and maintaining a more cohesive appearance and performance throughout the material of shirt 10.

It is understood that each of the elements described above, or two or more together may also find a useful application in other types of methods differing from the type described above. While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An article for the protection of a person's arm from work-surface transfer heat, said article comprising:

a front panel, a back panel and at least one principal sleeve;

a shirt body formed by the connection of said front panel to said back panel;

each said principal sleeve having an interior, a front, a back, a cuff, a sleeve top, a sleeve bottom and a sleeve lateral midpoint;

said principal sleeve connected to said shirt body proximate to the junction of said front panel and said back panel so each said principal sleeve can accommodate one said person's arm, said cuff distal said connection to said shirt body, said sleeve lateral midpoint between said cuff and said connection to said shirt body;

at least one partial secondary sleeve, each said partial secondary sleeve having a bottom edge, a top edge, a first edge, and a second edge, each said partial secondary sleeve attached to one said principal sleeve at said sleeve interior, each said bottom edge attached to said cuff, each said top edge attached between said sleeve lateral midpoint and said connection to said shirt body, each said first edge attached to said sleeve front between said sleeve top and said sleeve bottom, and each said second edge attached to said sleeve back between said sleeve top and said sleeve bottom.

2. The article as described in claim 1 wherein:

at least one said partial secondary sleeve being pliable.

3. The article as described in claim 1 wherein:

at least one said partial secondary sleeve is composed of the same material as said principal sleeve.

4. The article as described in claim 1 wherein:

at least one said partial secondary sleeve is constructed of multiple layers of material.

5. The article as described in claim 1 further comprising:

said front panel having a left portion and a right portion.

6. An article for the protection of at least one forearm, wrist and elbow of a person from work-surface heat transfer, said article comprising:

at least one front panel having a left portion and a right portion;

a back panel being permanently attached to said at least one front panel;

at least one principal sleeve, each said principal sleeve having an interior, an upper edge, a lower edge, a front, a back, and a lateral midpoint;

said at least one principal sleeve permanently attached to one said at least one front panel, said at least one principal sleeve extending from said one said front panel to a cuff;

at least one said at least one principal sleeve having a partial secondary sleeve; said partial secondary sleeve having a first edge, a second edge, a top edge and a bottom edge; said partial secondary sleeve being pliable;

said bottom edge of said partial secondary sleeve permanently attached to said at least one principal sleeve at said interior at said cuff;

said top edge of said partial secondary sleeve permanently attached to said at least one principal sleeve at said interior between said lateral midpoint and said front panel;

said first edge of said partial secondary sleeve permanently attached to said at least one principal sleeve at said interior between said upper edge of said front and said lower edge of said front; and said second edge of said partial secondary sleeve permanently attached to said at least one principal sleeve at said interior between said upper edge of said back and said lower edge of said back.

7. The article as described in claim 6 wherein:

said partial secondary sleeve being pliable.

8. The article as described in claim 6 wherein:

said partial secondary sleeve is composed of the same material as said principal sleeve.

9. The article as described in claim 6 wherein:

said partial secondary sleeve is constructed of multiple layers of material.

10. An article for the protection of a person's left and right forearms, wrists and elbows from work-surface heat transfer, said article comprising;

at least one front panel having a left portion and a right portion;

a back panel being permanently attached to said at least one front panel;

a right principal sleeve; said right principal sleeve having an interior, an upper edge, a lower edge, a front, a back, and a lateral midpoint;

said right principal sleeve permanently attached to said right portion of said front panel; said right principal sleeve extending from said right portion of said front panel to a right cuff;

said right principal sleeve having a right partial secondary sleeve; said right partial secondary sleeve having a first edge, a second edge, a top edge and a bottom edge; said partial secondary sleeve being pliable;

said bottom edge of said right partial secondary sleeve permanently attached to said right principal sleeve at said interior of said right principal sleeve at said right cuff;

said top edge of said right partial secondary sleeve permanently attached to said right principal sleeve at said interior of said right principal sleeve between said lateral midpoint of said right principal sleeve and said front panel;

said first edge of said right partial secondary sleeve permanently attached to said right principal sleeve at said interior of said right principal sleeve between said upper edge of said front of said right principal sleeve and said lower edge of said front of said right principal sleeve;

said second edge of said right partial secondary sleeve permanently attached to said right principal sleeve at said interior of said right principal sleeve between said upper edge of said back of said right principal sleeve and said lower edge of said back of said of said right principal sleeve;

a left principal sleeve, said left principal sleeve having an interior, said left principal sleeve having an upper edge, said left principal sleeve having a lower edge, said left principal sleeve having a front, said left principal sleeve having a back, said left principal sleeve having a lateral midpoint;

said left principal sleeve permanently attached to said left portion of said front panel, said left principal sleeve extending from said left portion of said front panel to a left cuff;

said left principal sleeve having a left partial secondary sleeve, said left partial secondary sleeve having a first edge, said left partial secondary sleeve having a second edge, said left partial secondary sleeve having a top edge, said left partial secondary sleeve having a bottom edge, said partial secondary sleeve being pliable;

said bottom edge of said left partial secondary sleeve attached to said left principal sleeve at said interior of said left principal sleeve from said left cuff;

said top edge of said left partial secondary sleeve attached to said left principal sleeve at said interior of said left principal sleeve between said lateral midpoint of said left principal sleeve;

said first edge of said left partial secondary sleeve attached to said left principal sleeve at said interior of said left principal sleeve between said upper edge of said front of said left principal sleeve and said lower edge of said front of said left principal sleeve; and said second edge of said left partial secondary sleeve attached to said left principal sleeve at said interior of said left principal sleeve between said upper edge of said back of said left principal sleeve and said lower edge of said back of said left principal sleeve.

11. The article as described in claim 10 wherein:

said left partial secondary sleeve being pliable.

12. The article as described in claim 10 wherein:

said right partial secondary sleeve being pliable.

13. The article as described in claim 10 wherein:

said left partial secondary sleeve is composed of the same material as said left principal sleeve.

14. The article as described in claim 10 wherein:

said right partial secondary sleeve is composed of the same material as said right principal sleeve.

15. The article as described in claim 10 wherein:

said left partial secondary sleeve is constructed of multiple layers of material.

16. The article as described in claim 10 wherein:

said right partial secondary sleeve is constructed of multiple layers of material.

* * * * *